US008855338B2

(12) United States Patent
Lyon

(10) Patent No.: US 8,855,338 B2
(45) Date of Patent: Oct. 7, 2014

(54) TRANSDUCERS EMPLOYING BOWED LAMINA

(76) Inventor: Richard H. Lyon, Belmont, MA (US)

( * ) Notice: Subject to any disclaimer, the term of this patent is extended or adjusted under 35 U.S.C. 154(b) by 0 days.

(21) Appl. No.: 13/571,618

(22) Filed: Aug. 10, 2012

(65) Prior Publication Data

US 2013/0044902 A1 Feb. 21, 2013

Related U.S. Application Data

(60) Provisional application No. 61/522,764, filed on Aug. 12, 2011.

(51) Int. Cl.

| | |
|---|---|
| ***H04R 25/00*** | (2006.01) |
| ***H04R 1/44*** | (2006.01) |
| *H04R 15/00* | (2006.01) |
| *H04R 17/00* | (2006.01) |

(52) U.S. Cl.

CPC *H04R 1/44* (2013.01); *H04R 15/00* (2013.01); *H04R 17/00* (2013.01)

USPC ..... 381/182; 381/190; 381/403; 381/405; 381/407

(58) Field of Classification Search

USPC ..... 381/403, 405, 407, 182, 190

See application file for complete search history.

(56) References Cited

U.S. PATENT DOCUMENTS 4,322,583 A * 3/1982 Maeda ..... 381/425

* cited by examiner

*Primary Examiner* — Davetta W Goins
*Assistant Examiner* — Amir Etesam

(57) ABSTRACT

A new type of sound transducer, with high output capability and compact size employs a motor in combination with a displacement amplification system using curved lamina. The motor may be electrostatic, such as piezoelectric, or electrodynamic, such as magnetostrictive, or balanced armature. Newer forms of driver materials such as PMN-PT and layered PZT or Galfenol or Terfenol-D are examples. The design exhibits high source levels, smooth frequency response and uniform directivity. Although the application described herein relates to a low frequency sound source for underwater use, the design is not restricted to low frequencies or to an underwater sound source. Both sound production and reception may be conducted. Further, diaphragmatic displacement pumps and sensors may be equipped with curved lamina, which experience a change of curvature upon excitation of their edges, and which may generate displacement of their edges due to changes of their curvature.

25 Claims, 7 Drawing Sheets

$$R^2=(L/2)^2+(R-\Delta)^2$$
$$0\approx L^2/4-2R\Delta$$
$$R=L^2/8\Delta$$

TRANSDUCERS EMPLOYING BOWED LAMINA

RELATED APPLICATION

This claims priority to U.S. Provisional Patent application No. 61/522,764, filed on Aug. 12, 2011, in the name of Richard H. Lyon, entitled, SOUND SOURCE EMPLOYING MOTION AMPLIFYING LAMINA, the full disclosure of which is hereby fully incorporated herein by reference.

GOVERNMENT RIGHTS

These inventions were made with government support under Contract No. N00014-11-M-0251 awarded by the U.S. Navy Office of Naval Research. The government has certain rights in these inventions.

INTRODUCTION

This describes a new class of sonar sound sources and receivers (together, transducers) as well as displacement transducers, pumps and meters. Known transducers attempt to produce greater amplitude of output signal, and also greater sensitivity to received signals, by coupling a transducing element such as a motor or piezoelectric element, to a resonant mode of a surrounding structure, in which the surrounding structure is an essential part of the system dynamics. In that case, amplification of transducer motion is due to the structural resonance and only occurs over the bandwidth of the resonance. However, very low frequency signals, which are often of interest for military signaling and sensing, as well as naturalistic endeavors (such as monitoring sounds produced by whales and other organisms) are rarely, if ever, within the resonance bandwidth of practical equipment, due in part to the very long wavelengths of such low frequency signals. Known diaphragm pumps employ a generally flat diaphragm that is drive inward and outward to produce displacement of working fluid. Analogous diaphragmatic sensors employ a diaphragm that is moved by a medium in which a signal is to be sensed, which diaphragmatic motion is transmitted to other equipment that measures the motion, thereby constituting a sensor. Such devices are limited in sensitivity and scope to the linear motion of the diaphragm and its associated drive mechanism (or sensing linkage). To some extent, the linear motion of the diaphragm is limited by its diameter, because its motion must stretch it.

Thus there is a need for transducers that are sensitive to very low frequency sounds, and which sensitivity is enhanced without regard to structural resonances of the transducer. Further, there is a need for a means and apparatus to provide amplification to transducers that is independent of the system dynamics. There is also a need for a means to provide higher sensitivity to diaphragmatic displacement devices, both pumping and sensing, which does not greatly increase the size of the device, if at all.

BRIEF DESCRIPTION OF THE FIGURES OF THE DRAWING

These and other objects of inventions disclosed herein will be more fully understood and explained with reference to the Figures of the Drawing, of which.

BRIEF SUMMARY

Inventions described herein are new for many reasons, at least because the design and construction of an acoustical driver 3, also referred to herein as a motor or exciter of a transducer 1, is dynamically independent from the dynamics of the radiating structure of edge supported sound amplifying lamina 6. The driver 3 may comprise a set of a plurality of core rings 2 of signal responsive material, such as magnetostrictive (MS) or piezoelectric (PZ), designed to operate at frequencies less than the lowest resonance of the transducer 1 structure. Example materials for MS elements are Galfenol; Terfenol-D, and compounds of iron and nickel. Example PZ materials are PMN-PT, PNZ-PT, and PZT. The lamina 6 are also non-resonant in the frequency range of interest and are structurally mobile compared to the driver 3. But they deform in such a way that the displacement of the driver 3 is amplified and the sound radiated (or received) is correspondingly amplified. The result is a design that is smooth in the response phase and amplitude. This makes the transducer 1 a better transmitter (and receiver) of complex signals with less phase and magnitude distortion than a driver 3 would be without lamina 6. It also provides increased output over other designs at equivalent size, along with and flexibility in the use of transducer (PZ and MS) materials.

It is also possible to used a similarly curved laminum for the diaphragm of a displacement pump. Rather than simply exciting a flat diaphragm to move in a direction perpendicular to its surface, it is possible to use a curved diaphragm. A pair of opposite edges of the curved diaphragm are spread away from each other, thus flattening the bow of the curve, or drawn toward each other, thus increasing the degree of bowing of the curve. Another way to describe the situation is that moving the opposite edges changes the volume within the device chamber, and can expel or draw in fluid. This change in degree of curvature also causes motion of the curved part of the diaphragm in a direction perpendicular to a tangent at its curved midpoint, which motion can be applied to displace fluid as with a conventional pump, or to be displaced by same, as with a conventional sensor. However, actuation is by using a curved diaphragm, and driving its edges, rather than its center, or surface.

DETAILED DESCRIPTION

Figure 1A:
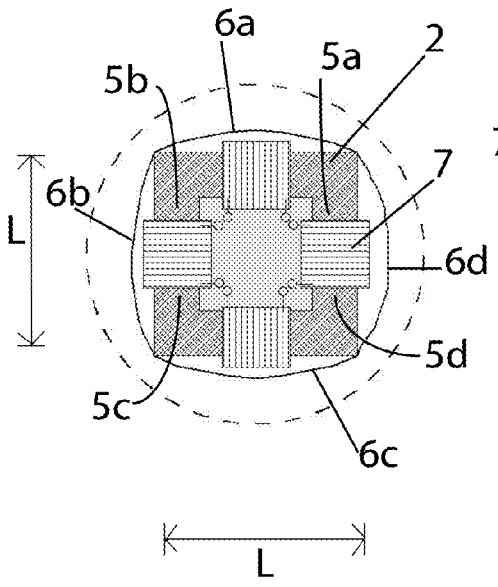
FIG. 1A is an end view of the transducer shown in FIG. 1.
Figure 1:
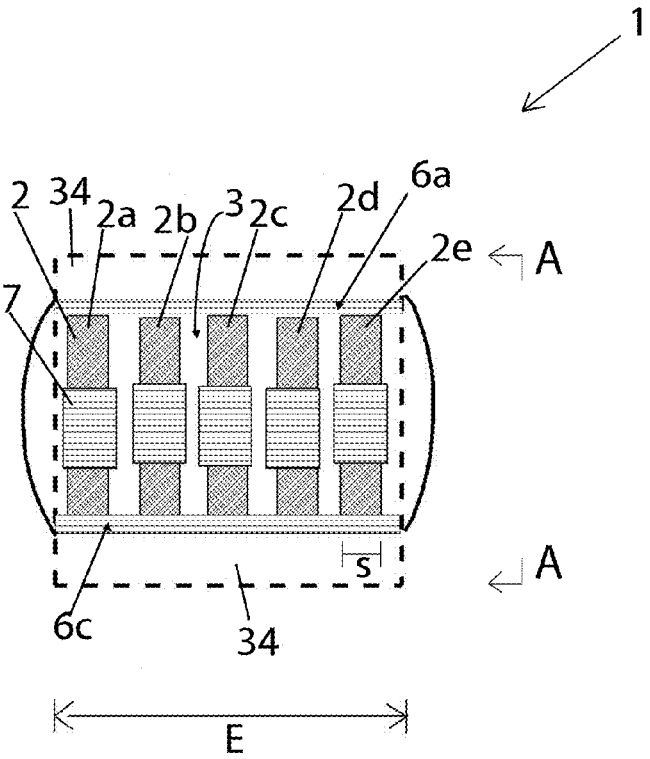
FIG. 1 is a schematic representation of a low-frequency transducer of an invention hereof employing magnetostrictive (MS) rings and displacement amplifying lamina, in a side view.

A schematic sketch of an important embodiment of a disclosed transducer 1 is shown in FIGS. 1 and 1A with FIG. 1A representing an end view of FIG. 1 along lines A-A. Although the implementation presented here utilizes Galfenol, a new magnetostrictive (MS) material that has high output and characteristics of malleability and machinability that enhance its practicality for the intended application, the inventions disclosed herein may also use other existing magnetostrictive materials or others to be developed. Galfenol is an alloy of iron and gallium.

In an exemplary design for a low frequency sonar transducer, the Galfenol is arranged in a set 2*a*, 2*b*, 2*c*, 2*d*, 2*e* of square core rings 2, each leg 5, of which there are four in this embodiment (5*a*, 5*b*, 5*c* and 5*d*) of a ring 2 having a length L of the order of 30 cm long, with a side thickness s of about 3 cm and a ring thickness t also of about 3 cm. (When it is not important which of legs 5*a*-5*d* are being discussed, the simple designation leg 5 will be used, to refer to any and all of them.) This provides a cross-section area for a leg 5 of about 3 cm×3 cm. The extent E of the overall driver 3 is also about 30 cm. (FIG. 1 is not to scale.) There are five core rings 2 (2*a*-2*e*) along its extent as shown in the illustrated embodiment. There may be more or fewer. A gap or cavity 9 exists between adjacent core rings 2. (When it is not important which of core rings 2*a*-2*e* are being discussed, the simple designation core ring 2 will be used, to refer to any and all of them.)

The area of a face of the four sided 30×30 cm driver 3 comprising the five core rings 2 and the gaps there between is approximately $4\times30\times30=3600\ cm^2$. For the transducer to produce, (e.g.), a 150 dB source level in water (referenced to 1 micro-pascal at 1 meter) at 10 Hz, it should dynamically displace about 100 cc of water. Thus, the radiating surface of the size mentioned above should move outward about 0.3 mm. When excitation is applied to the MS material via a signal current through a signal conductor, such as a coil or wire or the signal windings 7, the rings 2 expand as the MS material stretches and they shrink as the MS material compresses. The strain limit of Galfenol is about $10^{-4}$, so a 30 cm leg 5 can only safely expand by about 0.03 mm, which would result in a sound level of only about 130 dB. Thus, if one were merely to cover face of the set of cores and intervening gaps with a flat cover, the produced sound output would be less than is desired.

To obtain an additional 20 dB of displacement, a useful embodiment incorporates several (four as shown) displacement amplifying bowed lamina 6, which may be thought of as acoustical levers, as shown schematically in FIG. 1. Four such lamina 6*a*, 6*b*, 6*c* and 6*d* are shown in FIG. 1A, each associated with a corresponding leg (5*a*, 5*b*, 5*c*, 5*d*) of the set of cores 2. These lamina 6 are so flexible that they are only significant in their amplification role. They have very little, if any influence on the dynamics of the Galfenol rings 2. This independence is an important part of the design, since it allows the lamina 6 to be designed independently of the piezo or MS motor exciter 3. They can be designed principally for their amplifying effects because they do not affect the dynamics of the piezo or MS motor.

The lamina 6 have a sinusoidal curved (or bowed) rest profile, described by $y=Y \sin \pi x/L$, where y is the displacement (to be more, or less bowed) from a flat configuration, Y is a maximum bowing at the center, L is the length of a leg 5 of a core 2, which is the distance between the supported edges 32 of the laminum 6, x is the distance from a supported edge 32 (FIG. 3) of a laminum toward an opposite edge 32. When the length L of a leg 5 is decreased by $-\delta L$ due to excitation, the bowing amplitude of the lamina increases by $\delta Y=G\ \delta L$. The gain G is $G=4L/Y\pi^3$, which is the gain in the average displacement from a flat rigid laminum. (The laminum gain G is derived in Section A.2 below.) The desired 20 dB in gain is achieved by making the undisturbed shape of the lamina have the ratio L/Y=75, or a bowed shape of Y=4 mm for a length L=30 cm for leg 5.

In an exemplary embodiment, the lamina are coupled to the driver element 2 through a yoke 24. The yoke does several things. The yoke is itself fixed to the core 2 at its corners, where pairs of legs, e.g., 5*b* and 5*a* meet. As the core 2 and its legs 5 expand and contract, the end yoke portions 25 displace along with the legs. The end portions 25 also engage the edges 32 of the lamina 6, as discussed below. The yoke 24 has end portions 25, connecting elements 28, and a central portion 27, which engages a tensioning element 26. As a core element ring 2 expands, for instance, this puts tension in all of the elements of the yoke 24, through the end portions 25, the connecting element 28 the central portions 27 and the tensioning device 26. Because each laminum is coupled to a pair of yoke end portions 25, as the core element 2 expands, the edges of the laminum are spread away from each other, tending to flatten out the laminum from its rest bowed condition. Conversely, as a core element ring 2 contracts, this puts compression in all of the elements of the yoke 24, through the end portions 25, the connecting element 28 the central portions 27 and the tensioning device 26. Because each laminum is coupled to a pair of yoke end portions 25, as the core element 2 contracts, the edges of the laminum are pushed toward each other, tending to bow out the laminum from its rest bowed condition to an even more bowed condition.

Similarly, if the tensioning element 26 is turned so as to apply tension to all of the yoke elements, drawing all elements of the yoke 24 towards the centrally located tensioning element, this also tends to draw the laminum edges toward each other, causing the laminum to bow out from its rest bowed position to an even more bowed condition.

Existing transducers known as flextensional transducers have a piezoelectric or MS motor element that is coupled to a resonant mode of a surrounding structure or in which the structure attached to the piezo electric or MS element is an essential part of the system dynamics. In that case, amplification of motion is due to the structural resonance and only occurs over the bandwidth of the resonance.

In significant contrast, with the present inventions, amplification is due to the geometric arrangement of the driver 3 core elements 2 and the lamina 6. Amplification is independent of resonant frequency of either of these elements.

Thus, to summarize, as an electric signal passes through the windings 7 surrounding a core leg 5, due to the characteristics of the material (such as piezoelectric or magnetostrictive, etc.), the leg expands and contracts in response to the electrical signal. The expansion and contraction is along all dimensions, to different degrees. A useful measure of scale is the area defined by the combined surface area of each leg that faces outward, extending along a length L and a width s, as well as the spaces between such legs.

Figure 3:
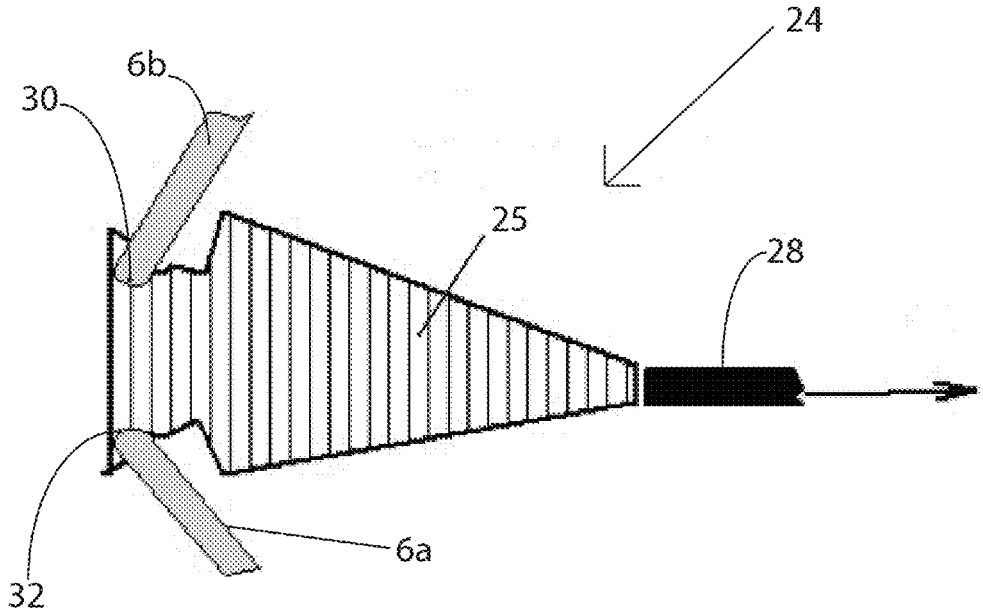
FIG. 3 is a schematic rendition showing a yoke arrangement for capturing and supporting lamina at the yoke ends, leaving edges of lamina free to rotate and thus minimizing any undesirable moments that might be applied.

An important feature of inventions disclosed herein is that a curved (also referred to herein as bowed) lamina be mechanically coupled to a core leg in such a way that expansion and contraction of the leg causes a change in the degree of bowing of the curved laminum. In the arrangement shown in FIGS. 1 and 1A, as a leg 5 expands outward, becoming longer, that spreads apart the edges 32 of the laminum 6 that is coupled to it, for instance through an end portion 25 of the yoke 24, as shown in FIG. 3. This causes the bow of the laminum 6 to flatten out from its rest position, so that the radius of curvature of the laminum becomes larger than it is in the rest position. Conversely, as a leg 5 contracts inward, becoming shorter, that draws toward each other the edges 32 of the laminum 6 that is coupled to it. This causes the bow of the laminum 6 to bulge or bow further out from its rest position, so that the radius of curvature of the laminum becomes smaller than it is in the rest position.

It should be noted that although square core portions are shown, each having four legs (each leg having a rectangular cross-section), other shapes, such as hexagons with six legs, triangular cores with three legs, and other, less regular, more arbitrary shapes of cores are also possible as are legs with other cross sections (e.g. circular, oval, triangular). What is important is that a curved lamina be mechanically coupled to a segment of a core in such a way that expansion and contraction of the core segment causes a change in the bowing of the laminum.

This general analysis is silent as to the thickness of the lamina 6. The discussion reasonably assumes that the bending rigidity of the bowed laminum 6 (6*a*, 6*b*, 6*c*, 6*d*) is small compared to the axial stiffness of the MS legs 5 (5*a*, 5*b*, 5*c*, 5*d*). But in underwater applications, there is a need to make the lamina 6 sufficiently thick so that the transducer 1 is able to resist water pressure at depth without buckling. (When it is not important which of laminum 6*a*-6*d* are being discussed, the simple designation laminum 6 will be used, to refer to any and all of them.)

Magnetic And Mechanical Bias Of Transducers

To achieve the desired operating behavior in terms of sensitivity, linearity, and structural stability, it is beneficial to operate a MS or piezoelectric transducer with both a stress and electromagnetic bias. As shown schematically in FIG. 2, the magnetic bias for a MS transducer can be applied by a biasing element 22, such as a coil or by rare earth magnets. This bias is of the order of 500 Oersteds (Oe) or 40,000 amps/meter (A/m).

It is also advisable to provide a stress bias to the MS material to stabilize it mechanically and provide a favorable operating point for the MS activation. Typical stress bias values for Galfenol are 2 ksi (0.013 GPa). Considering its typical Young's modulus in the range of 200 GPa, the static bias strain is of the order of $10^{-4}$ or the same order as the dynamic strain limit of our design. This bias is also well above the stress induced by water pressure at 1000 ft. (0.003 GPa), so that the popping that sometimes occurs with piezo and MS transducers as depth pressure increases and the transducer material creeps or slips, is less likely.

Figure 2:
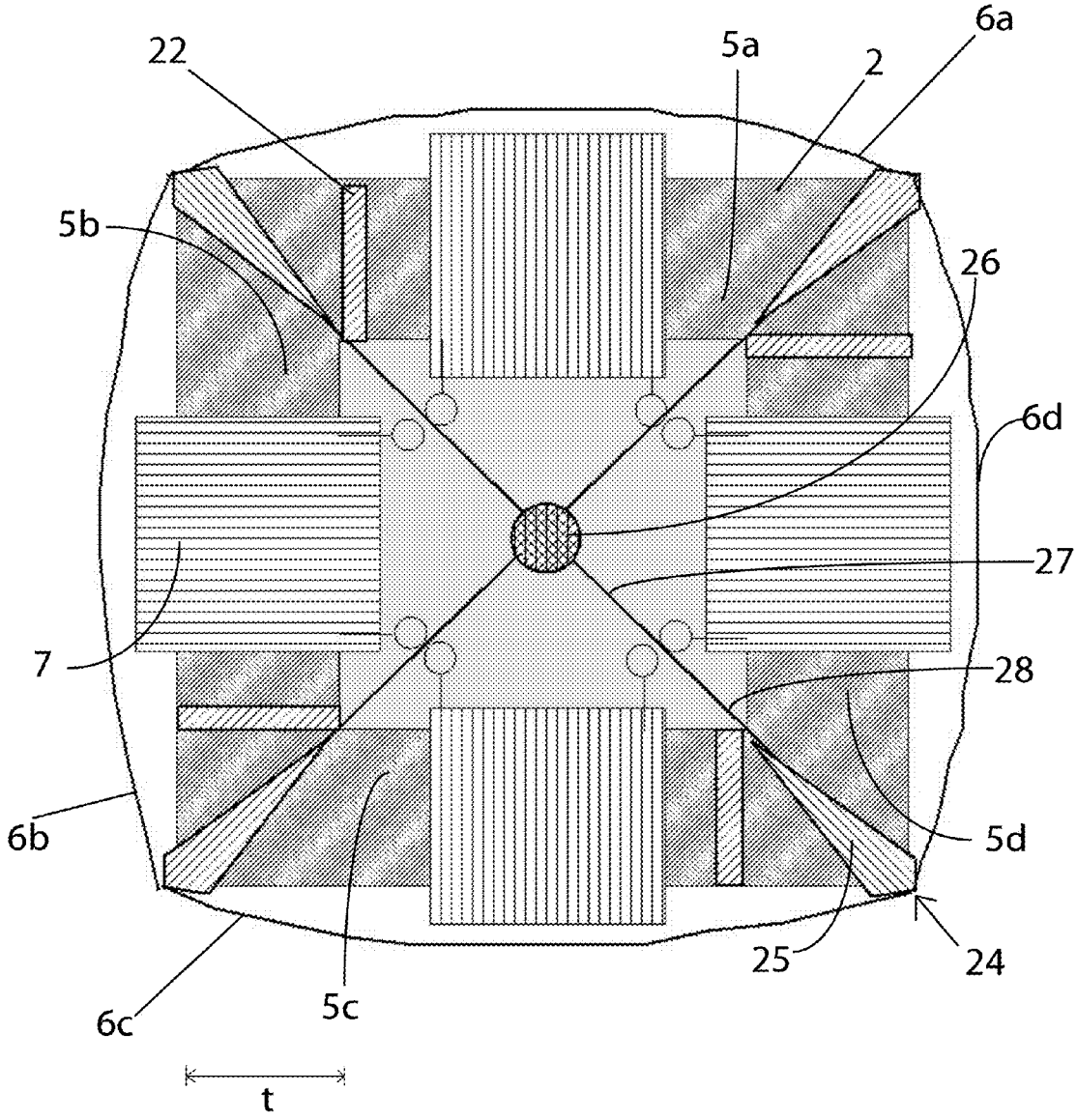
FIG. 2 is a schematic representation of a single MS ring, showing an arrangement for applying compressive stress bias to the MS material and attachment locations for the lamina.

One arrangement of providing this stress bias and attachment locations for the lamina 6 is shown schematically in FIG. 2. A yoke assembly 24 that engages the four corners of the MS ring 2 puts the legs 5*a*, 5*b*, 5*c*, 5*d*, into compression. The compression is adjusted using a mechanical turnbuckle 26 or similar mechanism at the center of the ring 2. The yoke 24 end portions 25 also acts as the connection between the rings 2 and the lamina 6*a*, 6*b*, 6*c*, 6*d* causing the lamina 6*a*, 6*b*, 6*c*, 6*d* to bend as the ring 2 legs 5*a*, 5*b*, 5*c*, 5*d* contract and expand. This concept is important in setting stress levels and in defining the boundary conditions for the lamina. It is desirable that the engagement between the yoke 24 and the lamina 6*a*, 6*b*, 6*c*, 6*d* apply only equal and oppositely directed forces to the lamina 6*a*, 6*b*, 6*c*, 6*d*, and that moments are minimized, so that the displacement of water is maximized. The schematic rendition of the engagement between the lamina 6*a*, 6*b*, 6*c*, 6*d* and the yoke 24 in FIG. 3 shows a rounded slot 30 in yoke end 25 into which the rounded edges 32 of the lamina 6*a*, 6*b* are placed, so that the lamina are firmly captured, but any edge moments are minimized and preferably eliminated. A connecting element 28 of any suitable sort, such as a cable or wire or bar, couples the central tightening mechanical turnbuckle 26 to a central portion 27 of the yoke, the connection portion 28 and to the engaging end 25 of the yoke 24. It will be noted that the end portions 25 of the yoke are coupled to the edges of the laminum in a manner to apply to the laminum only forces that are in a plane tangent to a surface of the laminum at each of the at least two laminum edges.

For underwater applications, as shown in FIGS. 1 and 1A, the lamina 6, the yoke elements 24, 25, 26, 27, 28 and the MS rings 2, can be encased in an elastomer (such as Rho-C rubber) sheath 34, which blocks water intrusion, helps to hold the lamina in place, and also acts as a damper for any structural resonances of the lamina that might occur in the operating frequency range.

Analytical Modeling

Figure 4:
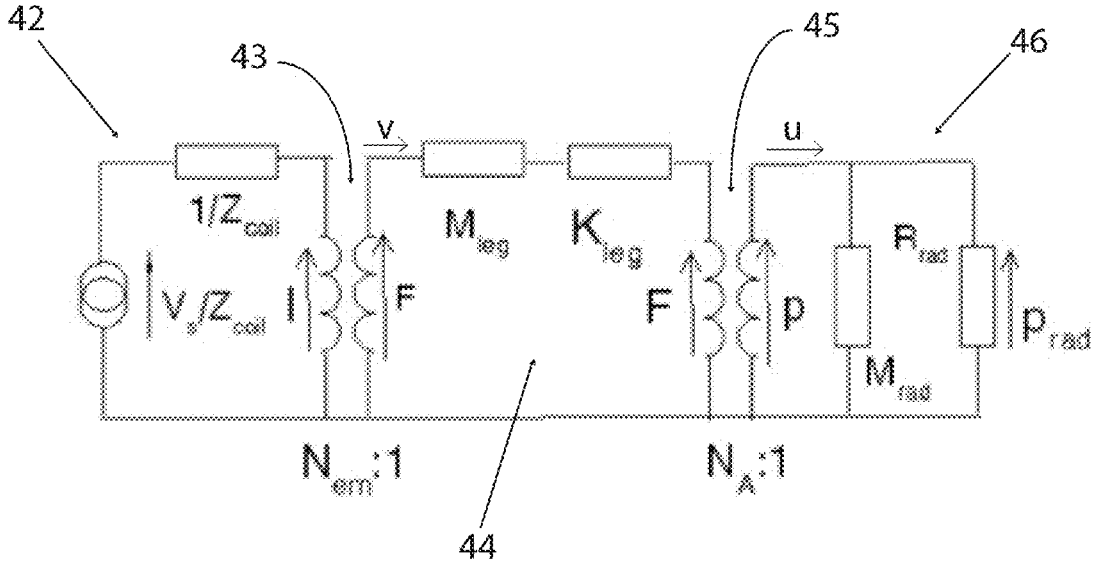
FIG. 4 shows, schematically, a circuit diagram model for a magnetostrictive low frequency transducer.

A schematic overview of an equivalent circuit design model of an example transducer shown in FIG. 1 is shown in FIG. 4. This model consists of three parts.

An electrical part 42 includes the drive voltage $V_s$ and the signal coil electrical admittance $1/z_{coil}$. The impedance $Z_{coil}=R_{coil}+jx_{coil}$. For an electrodynamic MS transducer, this part is an electrical admittance diagram (where V is the flow variable and I is the drop variable).

A mechanical part 44 includes the mass $M_{leg}$ and stiffness $K_{leg}$ of the MS ring segments 2. This part 44 is a mechanical impedance diagram (where v (velocity) is the flow variable and F (force) is the drop variable).

The acoustical part 46 includes the radiation mass $M_{rad}=\rho/4\pi a$ and radiation resistance $R_{rad}=\rho c/A_{lam}$ of the surrounding fluid. This part is an acoustical impedance diagram (where U (volume velocity) is the flow variable and p (pressure) is the drop variable).

The electrical 42 and mechanical 44 parts are coupled by an electrodynamic transformer 43 of turns ratio $N_{em}$ due to the MS action. ($N_{em}$ is derived below in Section A.1 below). The mechanical and acoustical parts are coupled by an area-gain transformer 45, with turns ratio $N_A=GA_{leg}$, where G is the lamina gain described above and $A_{leg}=A_{lam}/N_{seg}$ is the area of a lamina assigned to each leg 5 in the transducer. ($N_A$ is derived below in Section A.2 below). When these parameters are defined and quantified, a transfer function (TF) in terms of source sound level per volt of drive can be evaluated.

Figure 5:
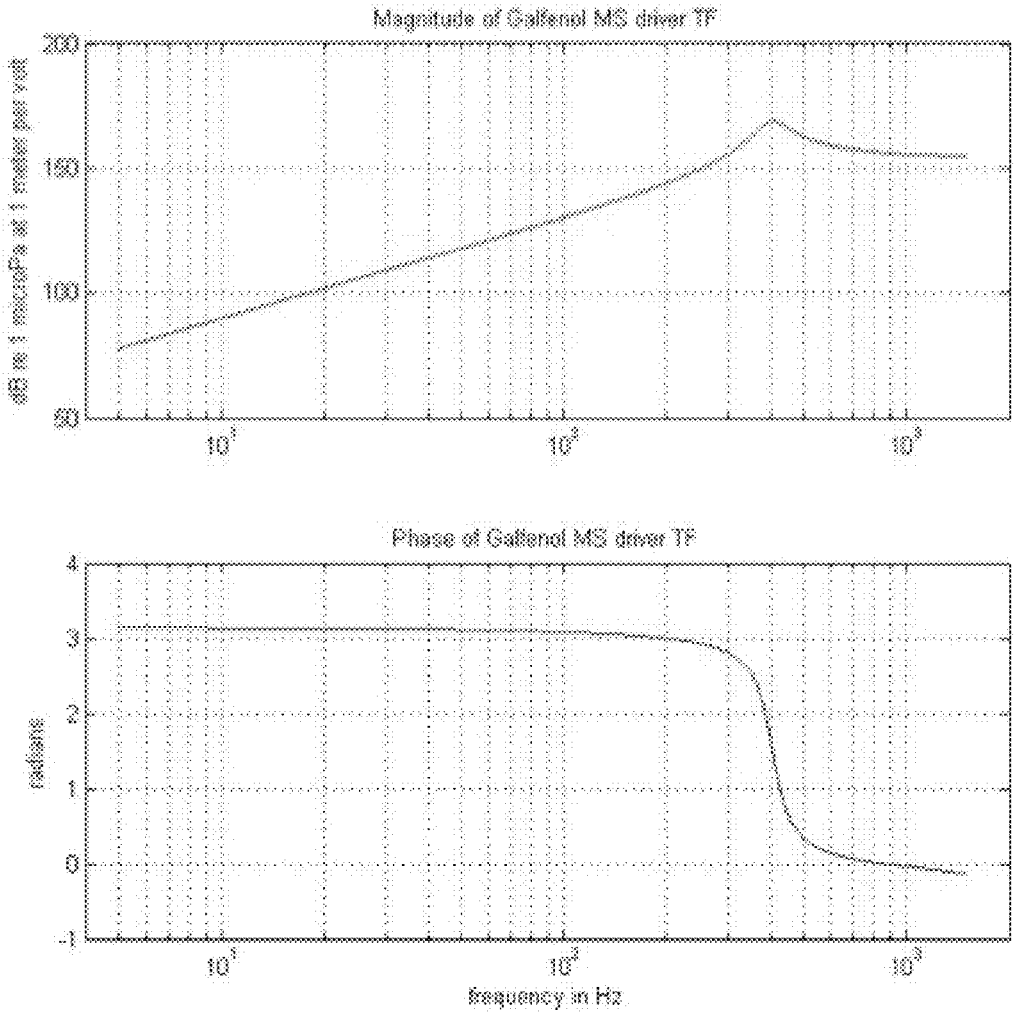
FIG. 5 shows, graphically, a calculated source level per volt TF for a 30 cm Galfenol magnetostrictive sound transducer, with the magnitude shown on the upper graph and the phase shown on the lower graph.

As an example, FIG. 5 shows, graphically, the calculated voltage to source level TF for a Galfenol-based transducer as described above and in FIG. 1, showing the magnitude of TF in the upper graph and the phase of TF in the lower graph.

The source strength plot shown in FIG. 5 indicates an increase in output with frequency at 40 dB/decade, which is due to the combination of monopole radiation resistance that increases as $f^2$, and the stiffness controlled compliant response of the radiating structure which also causes the response to increase as $f^2$. Consequently, the compensation required to make the source level independent of frequency (or flat) would be a double integrating circuit in the electrical drive.

Design Considerations

Galfenol is a preferred material for a core ring 2 of an MS transducer as disclosed, because of its large strain/H-field coefficient $d_{33}$, its high strain tolerance, and its malleability. It can be rolled into thin sheets and these can be cut to form laminations, reducing eddy current losses, such as those that would occur in Terfenol-D, which would otherwise be a good candidate except that its brittleness makes it difficult to form into laminations.

The important design depicted schematically in FIGS. 1 and 2 implicitly assumes that Galfenol would be the only material in the rings 2. But, to reduce materials cost, the Galfenol might fill only a portion of the magnetic circuit, with the remainder filled with mild steel laminations. This could also reduce size and weight, and mean less reluctance of the flux path. The reduction in sensitivity might possibly be accommodated by a higher, yet still acceptable, drive voltage.

The potential for dynamic strain levels of about $10^{-4}$ for the transduction material in this application was noted above. There are newer, single-crystal piezoelectric materials such as PMN-PT and PZN-PT and thin film PZT that do not have issues with eddy current losses, but would require higher drive voltages to achieve these strain amplitudes.

The compressive stress yoke elements 24 shown in FIG. 2 may also be the edge supports for the displacement amplifying lamina 6. As noted above, these supports must transmit the expansion and contraction of the MS ring 2 legs 5 to the edges 32 of the lamina 6 with minimal applied moment to the edge 32. This is because any such edge moments reduce the volume displacement of the bending laminum 6. A sample design concept for such a support is shown schematically in FIG. 3.

In some cases the stress bias may be introduced by the way the laminations of the core are cured or annealed to retain a residual stress in the core. In that case, a separate stress inducing element like the yoke may not be required. Thus, in that case, the edge supports for the displacement amplifying lamina may only be fittings that join the lamina to the core. They need not be connected to a tensioning device 26 and thus, there need be no connection portion 28 or central portions 27 of any yoke element. All that would be required are the end portions 25. In fact the core itself may be shaped to engage and couple the lamina in a moment-free manner, as discussed above.

A design issue of some importance in underwater applications is the structural stability of the displacement amplifying lamina 6. Water pressure at depth can buckle and crush the lamina if they are too thin or too flat. The result of a stability analysis for the tradeoff between the static bowed amplitude (where less bowing provides more gain) and laminum thickness for water pressure at 1650 ft (5 MPa) is shown graphically in FIG. 6. The sample design of L≈30 cm span and a 4 mm bowing amplitude indicates that the lamina should be about 12-about 18 mm thick.

The derivation of the thickness h and bowing amplitude Y relation is presented below in Section A.3.

Any suitable type of driver may be used, including but not limited to: an electrostatic motor, a magneto-strictive motor, a balanced armature motor, an electro-dynamic motor, and a piezoelectric motor.

Laminum Use with Displacement Pumps

Figure 8A:
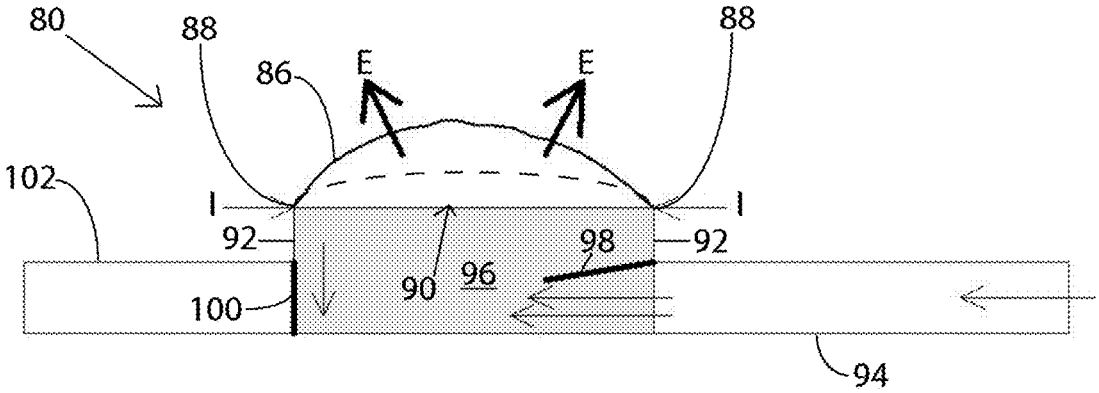
FIGS. 8A and 8B show a laminum as the diaphragm of a pump, with FIG. 8A showing the laminum in an outward position and FIG. 8B showing the laminum in an inward position.
Figure 8B:
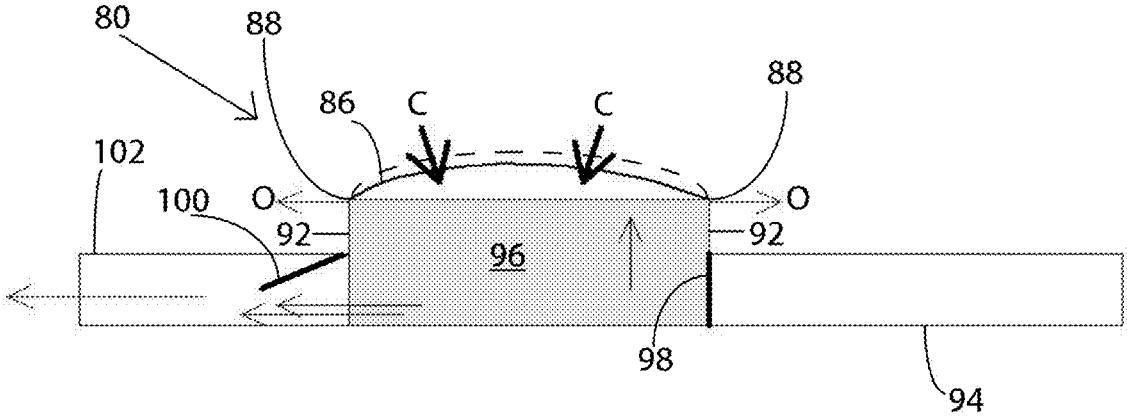

FIGS. 8A and 8B show, schematically, a cross-sectional side view of an improved diaphragm pump 80 of a type used in medical devices and gas flow control over what would be provided by a diaphragm with a planar rest position. A laminum 86 provides amplified pump displacement. Ordinarily, the displacement of a diaphragm in a displaced pump is limited by the throw of whatever drive mechanism is directly connected to the diaphragm. It is possible to use a bowed laminum 86 as a diaphragm for an improved device. Fluid flows into the device through the conduit 94, and into the diaphragm chamber 96 through valve 98, which is shown open in FIG. 8A and closed in FIG. 8B. FIG. 8A shows the situation as fluid is drawn into the chamber 96 and the laminum moves with an outward expansion, as indicated by the arrows E. This would occur if the driver elements 92 are operated to drive the edges of the laminum inward, as indicated by the arrows I, narrowing the space between them. The driver elements are shown in a generic fashion. Any suitable type may be used, including but not limited to: an electrostatic element, a magneto-strictive element, a balanced armature element, an electro-dynamic element, and a piezoelectric element. An exit valve 92 is shown closed. If the driver elements are operated to drive the edges of the laminum outward, widening the space between them, as indicated by the arrows O in FIG. 8B, the laminum is drawn inward in a contracting direction, as indicated by the arrows C, past its rest position (shown dotted line) to the position shown in FIG. 8B, expelling fluid through the valve 100, into exit conduit 102. Flapper valves are shown for the valves 98 and 100, but any suitable valve may be used. The laminum 86 has a bowed rest configuration as shown by dotted lines in FIGS. 8A and 8B.

The laminum diaphragm 86 illustrated in the figure is driven at its opposite edges 88 as shown by the arrows I (for inward driving), by driver elements of a suitable nature, which causes the diaphragm 86 to bow outward as shown in FIG. 8A, and O (for outward driving), which causes the diaphragm bow to flatten, as shown in FIG. 8B. The gain provided by laminum bowing allows the surface area of the diaphragm to be smaller in area than a planar diaphragm for any given throughput, or conversely, to have greater throughput for a given area. The laminum is coupled to the driver elements 92 at the edges 88, in a similar manner as described above for a sound transducer, so that any transferred moment is eliminated or minimized. As viewed from above, the laminum 86 could have a rectangular shape. Two opposite edges 88 (on the left and right, as shown) are coupled to the driving mechanism to be driven inward and outward. The other two opposite edges 90 (in and out of the paper, as shown) are free from driving. Other applications of diaphragms in gas flow control and monitoring can be similarly improved by taking advantage of laminum displacement amplification.

A laminum device could also be used as a pressure sensor, rather than as a source. In that case, it could be beneficially used connected so that fluid pressure to be measured is in the intake direction when used as a pump (that is, from the right, as shown in FIGS. 8A and 8B. It would work well, for instance in a chemistry lab, as a suction sensor, because this would keep the lamina in place.

In summary, inventions described herein include a transducer for the production of sound that incorporates an electrostatic or electrodynamic motor (also referred to herein as a driver or exciter) that is coupled to the surrounding fluid medium by a set of lamina that amplify the motion of the motor to produce greater sound output. The lamina are driven in-plane with no moment at their edges and have a curved or bowed rest shape that results in amplification of the volume displacement of the motor and thus more sound. The resistance to ambient pressure, important for some applications, is obtained by making the lamina thicker. Their volume displacement for a given edge motion is enhanced by supporting the edges with minimal moment restraint. The device also works in reverse as a receiver, and thus, it is referred to herein as a transducer.

The lamina 6 are designed for and defined by their high degree of flexibility compared to that of the motor 3 legs 5. Typically, they should have a separate axial stiffness that does not increase the axial stiffness of the legs 5 and lamina 6 combined by more than 10%. The axial stiffness of the leg 5 in the Galfenol motor is given by $K_{leg}=Y_{gal}A/L$ where $Y_{gal}$ is the elastic modulus of Galfenol, A is the cross sectional area of the leg, and L is its length. The stiffness added by the laminum is a more complicated formula, but is provided in *Roark's Formulas for Stress and Strain, 6th* Edition, Jan. 1, 1989, Table 18, Case 1b, page 241, which is incorporated fully herein by reference. Using the elastic and geometric parameters used for the Galfenol motor to compute the radiation curves in FIG. 5 and the laminum parameters derived in Section A.3 for stability, the stiffness added to the motor by the laminum increases and combined stiffness by less than 0.1%, well within the criterion for the effect on system stiffness that defines the elastic properties of a laminum.

Basic Relations

A.1 Magnetostriction Actuation

The basic magnetostriction (MS) relations from thermodynamics treating stress σ and magnetic field strength H as external forces are (A1), (A2) below:

$$\epsilon=S^H\sigma+d_{33}H$$

$$B=d^*_{33}\sigma+\mu_o\mu_i H \tag{A.1}$$

A reversible differential process requires that $d_{33}=d^*_{33}$, but the presence of hysteresis and finite sized variations in σ and H make the distinction advisable. For the purpose of this analysis, the following relation between strain and H-field when the fluctuating stress vanishes is used:

$$\epsilon=d_{33}H=d_{33}B/\mu_o\mu_i=d_{33}\phi/\mu_o\mu_i A, \tag{A.2}$$

where $d_{33}$ is the MS strain coefficient, B is the flux density in the MS material, φ is the flux, $\mu_o$ is the magnetic permeability of free space, $\mu_i$ is the relative permeability of the MS material, and A is the cross-sectional area of an MS core 2. (For the examples shown in FIGS. 1 and 2, A=s×t.)

The relative mechanical velocity, $V_{res}$, related to strain in the MS leg 5 can then be related to the rate of change in flux linkage $\lambda(=N_{sig}\phi)$ and also the total voltage $E(=d\lambda/dt)$ for a coil 7 having $N_{sig}$ windings by $$v_{res}=\frac{d}{dt}(\varepsilon L)=\frac{d_{33}L}{\mu_o\mu_i N_{sig}A}\frac{d\lambda}{dt}=N_{em}E. \tag{A.3}$$

The turns ratio $N_{em}$ is the ratio of the velocity of the transducer to the voltage applied to the signal coil 7. The fluctuating flux due to the coil current deforms the MS material. Taking reasonable (mks) values for the parameters for a transducer utilizing Galfenol as the MS material ($d_{33}=1\times10^{-8}$, L=0.3 m, $\mu_o=4\pi\times10^{-7}$, $\mu_i=50$, $N_{sig}=1000$, A=19 cm$^2$), gives a theoretical value of $N_{em}=0.05$ for each transducer leg 5 of the length L.

A.2 Displacement Amplification by the Lamina

The shape of each of the lamina 6 (e.g. 6*a*, 6*b*, 6*c* or 6*d*) shown in FIGS. 1 and 2 is taken to be of the form $$y(x)=Y\sin(\pi x/L) \tag{A.4}$$

where Y is the height of the lamina at mid point x=L/2, and L is the length of a leg 5 of the core 2, which is also the distance between the two points of the engagement of the edges 32 of a laminum 6 with the yoke fitting 24 and thus to core 2 leg 5. The differential elements of the lamina 6 have a length $$ds=\sqrt{dx^2+dy^2}=dx\sqrt{1+(dy/dx)^2}\approx dx[1+(dy/dx)^2/2] \tag{A.5}$$

as long as Y is fairly small compared to L.

Due to its originally bowed rest shape, the lamina 6 will bend as the core 2 leg 5 lengthens and contracts, keeping its original length of $$L_o=\int_{x=0}^{g=L}ds=\int_0^L dx\left[1+\frac{1}{2}\left(\frac{\pi}{L}\right)^2Y^2\cos^2\left(\frac{\pi x}{L}\right)\right]=L\left[1+\left(\frac{\pi Y}{2L}\right)^2\right]. \tag{A.6}$$

To see how Y changes as L changes (keeping $L_o$ fixed), Eq. (A.6) can be solved for Y to get $$Y^2=\left(\frac{2}{\pi}\right)^2L(L_o-L). \tag{A.7}$$

Taking the variation in $Y^2$ while keeping $L_o$ fixed but allowing the distance L between supports to vary leads to $$2Y\delta Y=\left(\frac{2}{\pi}\right)^2(L_o-2L)\delta L; \tag{A.8}$$

or, by letting $(L_o-2L)\approx-L$, $$G\equiv\frac{2}{\pi}\frac{\delta Y}{\delta L}\approx-\frac{4}{\pi^3}\frac{L}{Y}. \tag{A.9}$$

G represents the gain in volume displacement offered by the lamina 6 as the core 2 leg 5 length L changes by δL (e.g., 2/π times the center span displacement, where 2/π is the average of a sine function of unity amplitude over a half period). The minus (−) sign shows that as the core 2 expands, the lamina 6 contract and vice versa. This increase in volume displacement above that which would be directly induced by the end of each leg 5 is represented by an effective area in the velocity to acoustical volume velocity transformation that is a part of $N_A$:

$$N_A=GA_{lam};A_{lam}=4LL_t. \tag{A.10}$$

The parameter $N_A$ can be considered as a sort of transformer turns ratio between leg mechanical velocity and volume velocity into the surrounding medium, e.g., water.

A.3 Lamina Stability

Figure 7:
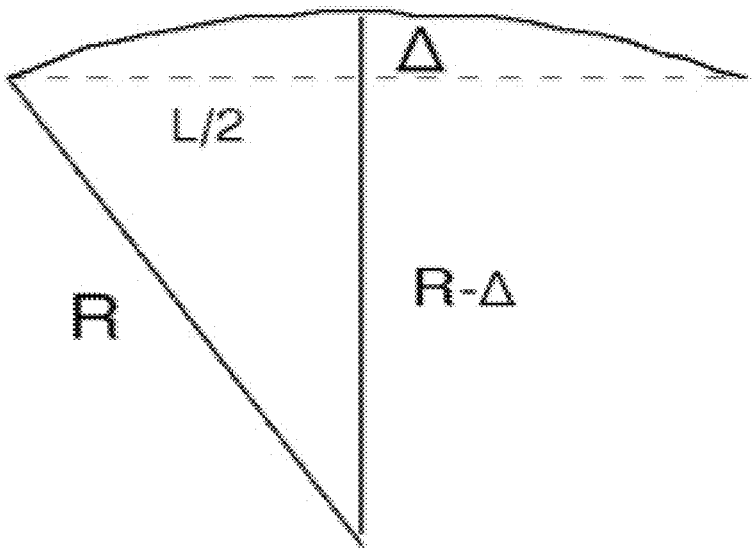
FIG. 7 shows derivation of the laminum radius of curvature.

The critical pressure load $P_{crit}$ for a pinned-pinned circular arch is given by (A3):

$$P_{crit}=\frac{Y_oI}{R^3}\left(\frac{\pi^2}{\alpha_2}-1\right);\ I=\frac{h^3}{12};\ R=\frac{L^2}{8\delta};\ \alpha=\sin^{-1}\left(\frac{L}{2R}\right), \tag{A.11}$$

where $Y_o$ is Young's modulus, h is the laminum 6 thickness, R is the radius of curvature (see FIG. 7), and α is the angle subtended by half the length of the laminum 6. Solving for h in terms of Δ for given values of L and $P_{crit}$ yields $$h = \left( \frac{12 P_{crit} R^3}{Y_o \left( \frac{\pi^2}{\alpha^2} - 1 \right)} \right)^{1/3}. \quad \text{(A.12)}$$

Figure 6:
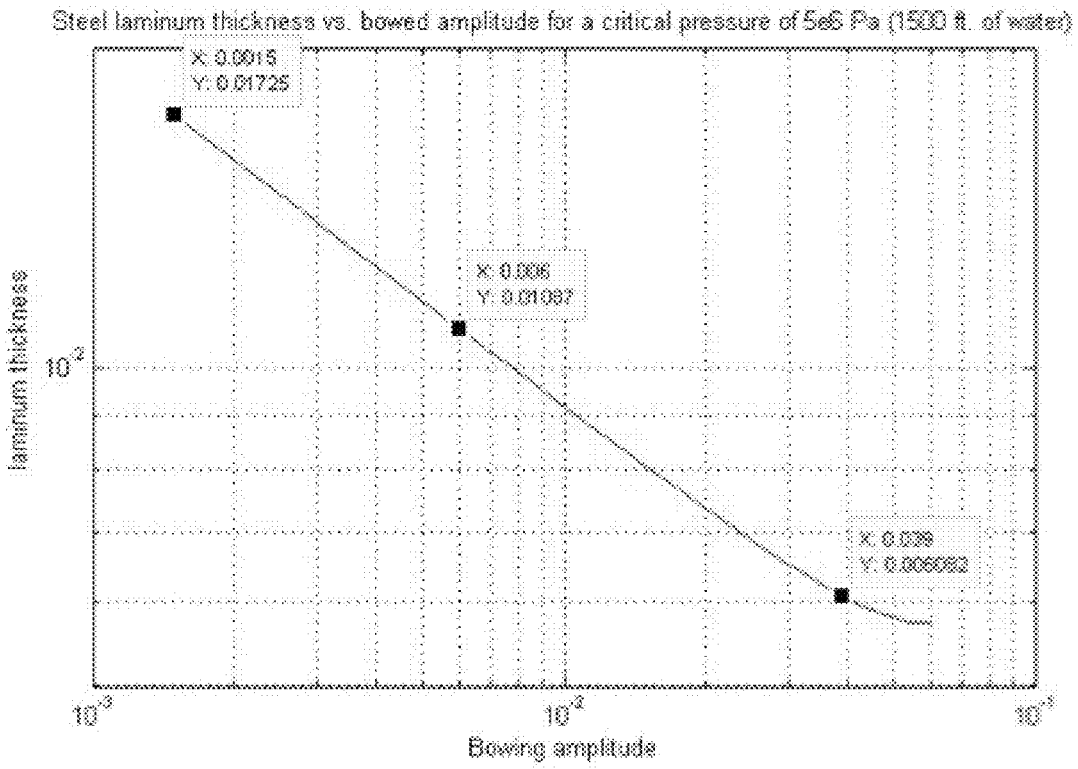
FIG. 6 shows, graphically, the required steel laminum thickness h for stability for different amounts of static bowing Y for a critical pressure of $5\times10^6$ Pa (1500 ft. of water)

This relation is plotted in FIG. 6.

SUMMARY

In a general sense, an invention disclosed herein is a sound transducer comprising: a driver, itself comprising a plurality of core portions, manufactured of a core material which, when excited by an electromagnetic signal, experiences a displacement as an expansion and contraction corresponding to the signal, the core portions arranged in a set, with a gap between adjacent core portions. The driver further includes a plurality of curved lamina. The lamina are disposed around the plurality of core portions, each laminum having a rest curvature, and each coupled to at least one core portion such that expansion and contraction of the at least one core portion causes a change in the degree of curvature of the coupled lamina, thereby generating a lamina displacement, which corresponds to the core displacement and thus the electromagnetic signal. The lamina are composed of materials and coupled to the core portions such that dynamics of a combination of the driver with lamina coupled thereto are the same as the dynamics of the driver without the lamina.

With an important embodiment, the driver may further comprise, for each core portion, at least one signal conductor that is wrapped around a portion of a core portion and through which a current can be passed to cause the respective core portion to expand or to contract. The driver may be of any suitable sort, including being selected from the group consisting of: an electrostatic motor, a magneto-strictive motor, a balanced armature motor, an electro-dynamic motor, and a piezoelectric motor.

A related yet also different invention disclosed herein is a displacement transducer comprising a driver, comprising a pair of drive elements, arranged with a space there-between, which, when excited by an electromagnetic signal, experience a displacement as a widening and narrowing of the space, corresponding to the signal. The displacement transducer also includes a curved laminum that has a rest curvature, and two edges, each edge coupled to a drive element, such that widening and narrowing of the space between the drive elements causes a change in the degree of curvature of the laminum, thereby generating a lamina displacement, which corresponds to the driver displacement and thus the electromagnetic signal.

A related displacement transducer further comprises, adjacent the laminum, a fluid chamber, into which fluid is drawn if the curvature of the laminum changes from a relatively larger radius of curvature to a relatively smaller radius, and from which fluid is expelled when the curvature of the laminum changes from a relatively smaller radius of curvature to a relatively larger radius.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

The invention claimed is:

1. A sound transducer comprising:

a. a driver, comprising a plurality of core portions, manufactured of a core material which, when excited by an electromagnetic signal, experiences a volume displacement as an expansion of an amount X and contraction of an amount Y, corresponding to the signal, the core portions arranged in a set, with a gap between adjacent core portions; and b. a plurality of curved lamina that are:

i. disposed around the plurality of core portions, each laminum having a rest curvature, each coupled to at least one core portion such that expansion of an amount X and contraction of an amount Y of the at least one core portion causes a change in the degree of curvature of the coupled lamina, thereby generating a lamina volume displacement, which corresponds to the core volume displacement and thus the electromagnetic signal, and which lamina volume displacement corresponding to a core expansion is greater than the amount X and which lamina volume displacement corresponding to a core contraction is greater than the amount Y; and ii. composed of materials and coupled to the core portions such that dynamics of a combination of the driver with lamina coupled thereto are the same as the dynamics of the driver without the lamina.

2. The sound transducer of claim 1, the driver further comprising, for each core portion, at least one signal conductor that is wrapped around a portion of a core portion and through which a current can be passed to cause the respective core portion to expand or to contract.

3. The sound transducer of claim 1, the driver being selected from the group consisting of: an electrostatic motor, a magneto-strictive motor, a balanced armature motor, an electro-dynamic motor, and a piezoelectric motor.

4. The sound transducer of claim 1, each laminum having at least two edges, the transducer further comprising a yoke element, which couples the at least two edges of a laminum to at least one core portion.

5. The sound transducer of claim 4, the yoke having two end portions that are coupled to the edges of a laminum, the yoke further comprising a central portion that is coupled to a tensioning device arranged to draw the end portions and thus the edges of the laminum, toward each other.

6. The sound transducer of claim 4, wherein the end portion of the yoke is coupled to the edges of the laminum without transmitting any moment to the laminum at the respective edges.

7. The sound transducer of claim 4, wherein the end portions of the yoke are coupled to the edges of the laminum in a manner to apply to the laminum only forces that are in a plane tangent to a surface of the laminum at each of the at least two laminum edges.

8. The sound transducer of claim 1, further comprising, for each core portion, a stress bias element.

9. The sound transducer of claim 1, further comprising, for each core portion, an electromagnetic bias element.

10. The sound transducer of claim 8, the electromagnetic bias element comprising at least one rare earth magnet.

11. The sound transducer of claim 9, the stress bias element comprising an adjustable yoke mechanism.

12. The sound transducer of claim 1, the core material also being such that when it experiences displacement as a contraction and expansion, it produces an electromagnetic signal.

13. The sound transducer of claim 1, the driver comprising a sound source.

14. The sound transducer of claim 1, the driver comprising a sensor.

15. The sound transducer of claim 12, further wherein the laminum are arranged and coupled to the core portions such that when a lamina experiences a lamina displacement signal, at least one core portion to which the lamina is coupled, produces an electromagnetic signal.

16. The sound transducer of claim 1, at least one core portion comprising a rectangular ring.

17. The sound transducer of claim 1, at least one laminum having two pairs of opposing edges.

18. A displacement transducer comprising:

a. a driver, comprising a pair of drive elements, arranged with a space there-between, which, when excited by an electromagnetic signal, experience a displacement as a widening and narrowing of the space, corresponding to the signal, and b. a curved laminum that has a rest curvature, and two edges, each edge coupled to a drive element, such that widening and narrowing of the space between the drive elements causes a change in the degree of curvature of the laminum, thereby generating a laminum volume displacement, which corresponds to the driver displacement and thus the electromagnetic signal.

19. A displacement transducer comprising:

a. a driver, comprising a pair of drive elements, arranged with a space there-between, which, when excited by an electromagnetic signal, experience a displacement as a widening and narrowing of the space, corresponding to the signal, and b. a curved laminum that has a rest curvature, and two edges, each edge coupled to a drive element, such that widening and narrowing of the space between the drive elements causes a change in the degree of curvature of the laminum, thereby generating a laminum displacement, which corresponds to the driver displacement and thus the electromagnetic signal, and c. adjacent the laminum, a fluid chamber, into which fluid is drawn if the curvature of the laminum changes from a relatively larger radius of curvature to a relatively smaller radius, and from which fluid is expelled when the curvature of the laminum changes from a relatively smaller radius of curvature to a relatively larger radius.

20. The transducer of claim 19, the drive elements being selected from the group consisting of: an electrostatic element, a magneto-strictive element, a balanced armature element, an electro-dynamic element, and a piezoelectric element.

21. The transducer of claim 19, the laminum having at least two edges, the transducer further comprising, for each edge, a connection element, which couples the edge to a driver element without transmitting any moment to the laminum at the edge.

22. The transducer of claim 19, the laminum having at least two edges, the transducer further comprising, for each edge, a connection element, which couples the edge to a driver element in a manner to apply to the laminum only forces that are in a plane tangent to a surface of the laminum at each of the at least two laminum edges.

23. The transducer of claim 19, the driver comprising a pump driver.

24. The transducer of claim 19, the driver comprising a vacuum sensor.

25. The transducer of claim 19, further wherein the laminum is arranged and coupled to the driver elements such that when the laminum experiences a change in the degree of curvature, at least one driver element to which the laminum is coupled, produces an electromagnetic signal.

* * * * *